US011798485B2

(12) United States Patent
Lv

(10) Patent No.: US 11,798,485 B2
(45) Date of Patent: Oct. 24, 2023

(54) GOA CIRCUIT AND DISPLAY PANEL

(71) Applicant: TCL CHINA STAR OPTOELECTRONICS TECHNOLOGY CO., LTD., Shenzhen (CN)

(72) Inventor: Xiaowen Lv, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 440 days.

(21) Appl. No.: 17/050,280

(22) PCT Filed: May 26, 2020

(86) PCT No.: PCT/CN2020/092345
§ 371 (c)(1),
(2) Date: Oct. 23, 2020

(87) PCT Pub. No.: WO2021/184544
PCT Pub. Date: Sep. 23, 2021

(65) Prior Publication Data

US 2023/0122055 A1 Apr. 20, 2023

(30) Foreign Application Priority Data

Mar. 18, 2020 (CN) ..... 202010190289.3

(51) Int. Cl.
*G09G 3/3266* (2016.01)
*G09G 3/36* (2006.01)

(52) U.S. Cl.
CPC ..... *G09G 3/3266* (2013.01); *G09G 3/3677* (2013.01); *G09G 2300/0408* (2013.01); *G09G 2310/08* (2013.01); *G09G 2320/043* (2013.01)

(58) Field of Classification Search
CPC ..... G09G 3/003; G09G 3/3614; G09G 3/36; G09G 3/3648
See application file for complete search history.

(56) References Cited

U.S. PATENT DOCUMENTS 11,551,604 B2 * 1/2023 Kim ..... G09G 3/3677
2016/0247822 A1 * 8/2016 Chen ..... G09G 3/3688
(Continued)

FOREIGN PATENT DOCUMENTS

CN 106486080 A 3/2017
CN 107424575 A 12/2017
(Continued)

OTHER PUBLICATIONS

International Search Report in International application No. PCT/CN2020/092345, dated Dec. 17, 2020.
(Continued)

*Primary Examiner* — Van N Chow
(74) *Attorney, Agent, or Firm* — PV IP PC; Wei Te Chung; Zhigang Ma

(57) ABSTRACT

A GOA circuit and a display panel are disclosed. The GOA unit includes a plurality of stages of cascaded GOA units. Each GOA unit includes a pull-up control module, a pull-up module, a down transmission module, a pull-down remaining module, a pull-down module and a bootstrap capacitor. The pull-up module is deployed with two thin-film transistors, to which different oscillating signals are inputted, having individual output ports. The two transistors can operate alternatively for reducing the time a single thin-film transistor operates, lowering the shift of a threshold voltage and extending a lifespan of the device.

13 Claims, 3 Drawing Sheets

(56) References Cited

U.S. PATENT DOCUMENTS

| | | | | |
|---|---|---|---|---|
| 2020/0020264 | A1* | 1/2020 | Chen | G09G 3/3266 |
| 2020/0105202 | A1* | 4/2020 | Yuan | G09G 3/3258 |
| 2020/0273419 | A1* | 8/2020 | Wang | G09G 3/3677 |
| 2021/0049971 | A1* | 2/2021 | Xiao | G06F 3/0412 |
| 2022/0114967 | A1* | 4/2022 | Xue | G09G 3/3266 |
| 2023/0035132 | A1* | 2/2023 | Kang | G09G 3/3688 |

FOREIGN PATENT DOCUMENTS

| | | | |
|---|---|---|---|
| CN | 107610736 | A | 1/2018 |
| CN | 109064964 | A | 12/2018 |
| CN | 110070838 | A | 7/2019 |
| KR | 20130121389 | A | 11/2013 |

OTHER PUBLICATIONS

Written Opinion of the International Searching Authority in International application No. PCT/CN2020/092345, dated Dec. 17, 2020.

Chinese Office Action issued in corresponding Chinese Patent Application No. 202010004429.3 dated Oct. 27, 2020, pp. 1-7.

* cited by examiner

GOA CIRCUIT AND DISPLAY PANEL

The present disclosure is a Notional Phase of PCT Patent Application No. PCT/CN2020/092345 having international filing date of May 26, 2020, which claims priority to Chinese Patent Application No. 202010190289.3, filed on Mar. 18, 2020, which is hereby incorporated by reference in its entirety.

FIELD OF THE DISCLOSURE

The present application relates to liquid crystal display technologies, and more particularly to a GOA circuit and a display panel.

DESCRIPTION OF RELATED ARTS

With improvement of thin-film transistor (TFT) performance, Gate driver on Array (GOA for short) technologies have been widely used in display panels. The GOA technologies can save driver IC (Gate IC), improve the yield and realize zero-bezel designs.

Please refer to FIGS. 1 and 2. FIG. 1 is a circuit diagram illustrating a GOA circuit in existing skills. FIG. 2 is a diagram illustrating a drive timing of the GOA circuit shown in FIG. 1.

As shown in FIG. 1, main architecture of the existing GOA circuit includes a plurality of stages of cascaded GOA units, wherein a n-th-stage GOA unit controls charging of a n-th-stage horizontal scan line, where n is a natural number. The n-th-stage GOA unit includes a pull-up control module 101, a pull-up module 102, a down transmission module 103, a pull-down remaining module 104, a pull-down module 105 and a bootstrap capacitor Cb that are electrically connected to a first node Q(n). G(n−4) is a (n−4)-th-stage scan signal, G(n) is a n-th-stage scan signal, G(n+5) is a (n+5)-th-stage scan signal; ST(n−4) is a (n−4)-th-stage stage transmission signal, ST(n+4) is a (n+4)-th-stage stage transmission signal; VSS is a first voltage level signal; CK(n) is a n-th-stage clock signal; LC1 is a first oscillating signal, LC2 is a second oscillating signal. The pull-up module includes a pull-up transistor T21, which outputs the scan signal G(n) under the control of the clock signal CK(n). The down transmission module includes a down transmission transistor T22, which outputs the stage transmission signal ST(n+4) under the control of the clock signal CK(n). The pull-down module includes a first pull-down transistor T31 and a second pull-down transistor T41, wherein the first pull-down transistor T31 is configured to pull down the potential of the scan signal G(n) and the second pull-down transistor T41 is configured to pull down the potential of the first node Q(n).

As shown in FIG. 2, the frequency of the stage transmission signal is 80 Hz, its period is 12.5 ms, and a duration of a pulse of the stage transmission signal of each frame is 25 μs at 20V, for example. In one frame, there are 271 cycles (45 μs) for each clock signal CK(n), that is, the duration of action of each clock signal CK is 12155 μs. The clock signal CK is a square wave, a high voltage level of which can be 20V and a low voltage level of which is 0V. An interval between the pulses of every two clock signals CK(n) and CK(n+1) is 1.125 μs. The inputted first voltage level signal Vss can be a direct-current signal of 4V. The inputted first oscillating signal LC1 and second oscillating signal LC2 are square waves and are inverses of each other. The period of the square waves is 2.5 s.

Technical Problems

In the existing GOA circuit, the pull-up transistor T21, serving as an output transistor, needs to drive the whole gate line (Gate) and to satisfy a corresponding falling time, and therefore needs to be made with a large size. Meanwhile, the pull-up transistor T21 directly connects to the clock signal line and acts as a load on the clock signal line, and therefore the capacitance of the clock signal line is large. This is because the current on the clock signal line is determined by both of the resistance and the capacitance based on the following formulas:

$$I_C = C\frac{dV_B}{dt}$$

$$X_C = \Delta t/C$$

$$X_C = \frac{1}{WC} = 1/2\pi fC$$

$$I = (V_2 - V_1)/(R + X_C)$$

When the capacitance becomes large, the current on the clock signal line will become large. This causes the whole clock signal line to generate heat. This problem is significant especially for high-resolution and high-refresh-rate products. The heating problem is a fatal problem for the GOA circuit. It will accelerate aging process of the device and may cause accident.

Therefore, there is a need to provide a display panel having a GOA circuit to overcome the afore-described drawbacks.

Technical Solutions

The objective of the present application is to provide a GOA circuit and a display panel, for carrying out avoiding the heating problem of a clock signal line caused when the capacitance of the clock signal line becomes large, and meanwhile, improving stability and lifespan of the circuit.

In a first aspect, an embodiment of the present application provides a GOA circuit, which includes a plurality of stages of cascaded GOA units, wherein a n-th-stage GOA unit controls charging of a n-th-stage horizontal scan line; the n-th-stage GOA unit including a pull-up control module, a pull-up module, a down transmission module, a pull-down remaining module, a pull-down module and a bootstrap capacitor; wherein the pull-up control module, electrically connected to a first node (Q(n)) and receiving a (n−p)-th-stage scan signal (G(n−p)) and a (n−p)-th-stage stage transmission signal (ST(n−p)), configured to pull down or pull up potential of the first node (Q(n)), wherein n and p are natural numbers and n>p;

the pull-up module, electrically connected to the first node (Q(n)) and receiving a first oscillating signal (LC1) and a second oscillating signal (LC2), configured to output a n-th-stage scan signal (G(n)) via a first port (A1) based on the first oscillating signal (LC1) and output the n-th-stage scan signal (G(n)) via a second port (A2) based on the second oscillating signal (LC2), wherein the first oscillating signal (LC1) and the second oscillating signal (LC2) are inverses of each other;

the down transmission module, electrically connected to the first node (Q(n)) and receiving the first oscillating signal (LC1), configured to output a (n+p)-th-stage stage transmission signal (ST(n+p));

the pull-down remaining module, electrically connected to the first node (Q(n)) and receiving a first voltage level signal (VSS), the first oscillating signal (LC1), the second oscillating signal (LC2) and the n-th-stage scan signal (G(n)), configured to keep the first node (Q(n)) at low potential;

the pull-down module, electrically connected to the first node (Q(n)) and receiving the first voltage level signal (VSS) and a (n+p+1)-th-stage scan signal (G(n+p+1)), configured to pull down the potential of the first node (Q(n)) and pull down the potential of the n-th-stage scan signal (G(n)); and the bootstrap capacitor, electrically connected to the first node (Q(n)) and receiving the n-th-stage scan signal (G(n)).

In the GOA circuit, the first oscillating signal (LC1) and the second oscillating signal (LC2) are square waves.

In the GOA circuit, the first port (A1) and the second port (A2) output alternatively.

In the GOA circuit, the pull-up control module includes a control transistor, a gate of which is configured to receive the (n−p)-th-stage stage transmission signal (ST(n−p)), a first electrode of which is configured to receive the (n−p)-th-stage scan signal (G(n−p)), and a second electrode of which is electrically connected to the first node (Q(n)).

In the GOA circuit, the pull-up module includes:

a first pull-up transistor, a gate of which is electrically connected to the first node (Q(n)), a first electrode of which is configured to receive the first oscillating signal (LC1), and a second electrode of which is electrically connected to the first port (1*l*) and is configured to output the n-th-stage scan signal (G(n)); and a second pull-up transistor, a gate of which is electrically connected to the first node (Q(n)), a first electrode of which is configured to receive the second oscillating signal (LC2), and a second electrode of which is electrically connected to the second port (A2) and is configured to output the n-th-stage scan signal (G(n)).

In the GOA circuit, the first pull-up transistor and the second pull-up transistor operate alternatively.

In the GOA circuit, the down transmission module includes a down transmission transistor, a gate of which is electrically connected to the first node (Q(n)), a first electrode of which is configured to receive the first oscillating signal (LC1), and a second electrode of which is configured to output the (n+p)-th-stage stage transmission signal (ST (n+p)).

In the GOA circuit, the pull-down remaining module includes:

a first remaining unit, electrically connected to the first node (Q(n)) and receiving the first oscillating signal (LC1), the first voltage level signal (VSS) and the n-th-stage scan signal (G(n)); and a second remaining unit, electrically connected to the first node (Q(n)) and receiving the second oscillating signal (LC2), the first voltage level signal (VSS) and the n-th-stage scan signal (G(n)).

In the GOA circuit, the pull-down module includes:

a first pull-down transistor, a gate of which is configured to receive the (n+p+1)-th-stage scan signal (G(n+p+1)), a first electrode of which is configured to pull down the potential of the n-th-stage scan signal (G(n)), and a second electrode of which is configured to receive the first voltage level signal (VSS); and a second pull-down transistor, a gate of which is configured to receive the (n+p+1)-th-stage scan signal (G(n+p+1)), a first electrode of which is configured to pull down the potential of the first node (Q(n)), and a second electrode of which is configured to receive the first voltage level signal (VSS).

In a second aspect, an embodiment of the present application further provides a display panel, including an array substrate, which includes a gate-on-array (GOA) circuit including a plurality of stages of cascaded GOA units, wherein a n-th-stage GOA unit controls charging of a n-th-stage horizontal scan line, and wherein the n-th-stage GOA unit includes:

a pull-up control module, electrically connected to a first node (Q(n)) and receiving a (n−p)-th-stage scan signal (G(n−p)) and a (n−p)-th-stage stage transmission signal (ST(n−p)), configured to pull down or pull up potential of the first node (Q(n)), wherein n and p are natural numbers and n>p;

a pull-up module, electrically connected to the first node (Q(n)) and receiving a first oscillating signal (LC1) and a second oscillating signal (LC2), configured to output a n-th-stage scan signal (G(n)) via a first port (A1) based on the first oscillating signal (LC1) and output the n-th-stage scan signal (G(n)) via a second port (A2) based on the second oscillating signal (LC2), wherein the first oscillating signal (LC1) and the second oscillating signal (LC2) are inverses of each other;

a down transmission module, electrically connected to the first node (Q(n)) and receiving the first oscillating signal (LC1), configured to output a (n+p)-th-stage stage transmission signal (ST(n+p));

a pull-down remaining module, electrically connected to the first node (Q(n)) and receiving a first voltage level signal (VSS), the first oscillating signal (LC1), the second oscillating signal (LC2) and the n-th-stage scan signal (G(n)), configured to keep the first node (Q(n)) at low potential;

a pull-down module, electrically connected to the first node (Q(n)) and receiving the first voltage level signal (VSS) and a (n+p+1)-th-stage scan signal (G(n+p+1)), configured to pull down the potential of the first node (Q(n)) and pull down the potential of the n-th-stage scan signal (G(n)); and a bootstrap capacitor, electrically connected to the first node (Q(n)) and receiving the n-th-stage scan signal (G(n)).

In the display panel, the first oscillating signal (LC1) and the second oscillating signal (LC2) are square waves.

In the display panel, the first port (A1) and the second port (A2) output alternatively.

In the display panel, the pull-up control module of the n-th-stage GOA unit includes a control transistor, a gate of which is configured to receive the (n−p)-th-stage stage transmission signal (ST(n−p)), a first electrode of which is configured to receive the (n−p)-th-stage scan signal (G(n−p)), and a second electrode of which is electrically connected to the first node (Q(n)).

In the display panel, the pull-up module of the n-th-stage GOA unit includes:

a first pull-up transistor, a gate of which is electrically connected to the first node (Q(n)), a first electrode of which is configured to receive the first oscillating signal (LC1), and a second electrode of which is electrically connected to the first port (A1) and is configured to output the n-th-stage scan signal (G(n)); and a second pull-up transistor, a gate of which is electrically connected to the first node (Q(n)), a first electrode of which is configured to receive the second oscillating signal (LC2), and a second electrode of which is electrically connected to the second port (A2) and is configured to output the n-th-stage scan signal (G(n)).

In the display panel, the first pull-up transistor and the second pull-up transistor operate alternatively.

In the display panel, the down transmission module of the n-th-stage GOA unit includes a down transmission transistor, a gate of which is electrically connected to the first node (Q(n)), a first electrode of which is configured to receive the first oscillating signal (LC1), and a second electrode of which is configured to output the (n+p)-th-stage stage transmission signal (ST(n+p)).

In the display panel, the pull-down remaining module of the n-th-stage GOA unit includes:

a first remaining unit, electrically connected to the first node (Q(n)) and receiving the first oscillating signal (LC1), the first voltage level signal (VSS) and the n-th-stage scan signal (G(n)); and a second remaining unit, electrically connected to the first node (Q(n)) and receiving the second oscillating signal (LC2), the first voltage level signal (VSS) and the n-th-stage scan signal (G(n)).

In the display panel, the pull-down module of the n-th-stage GOA unit includes:

a first pull-down transistor, a gate of which is configured to receive the (n+p+1)-th-stage scan signal (G(n+p+1)), a first electrode of which is configured to pull down the potential of the n-th-stage scan signal (G(n)), and a second electrode of which is configured to receive the first voltage level signal (VSS); and a second pull-down transistor, a gate of which is configured to receive the (n+p+1)-th-stage scan signal (G(n+p+1)), a first electrode of which is configured to pull down the potential of the first node (Q(n)), and a second electrode of which is configured to receive the first voltage level signal (VSS).

Beneficial Effects

Compared to the existing skills, the GOA circuit provided in the present application reduces the size of a part of transistors used in the circuit. The load on a clock signal line and electric current become small and heating problem can be alleviated. The pull-up module of the GOA circuit is deployed with two thin-film transistors, which are inputted with two different oscillating signals respectively, and have individual output ports, that is, each GOA circuit unit has two output ports. The pull-up module of the GOA circuit can operate alternatively and can reduce the pressure time of a single-one thin-film transistor (TFT), lower the shift of a threshold voltage (Vth shift) and extend the lifespan of the device. Moreover, a direct-current signal binds to the oscillating signal and a driving signal directly uses the oscillating signal in current circuit without having to occupy additional layout space, thereby reducing the room of bezel and cost in a further step.

DESCRIPTION OF EMBODIMENTS OF THE DISCLOSURE

The present application provides a gate-on-array (GOA) circuit and a display panel having the GOA circuit. To make the objectives, technical schemes, and effects of the present application more clear and specific, the present application is described in further detail below with reference to the embodiments in accompanying with the appending drawings. It should be understood that the specific embodiments described herein are merely for interpreting the present application and the present application is not limited thereto.

A GOA circuit provided in an embodiment of the present application will be described in detail below with reference to FIGS. 3 and 4.

Figure 3:
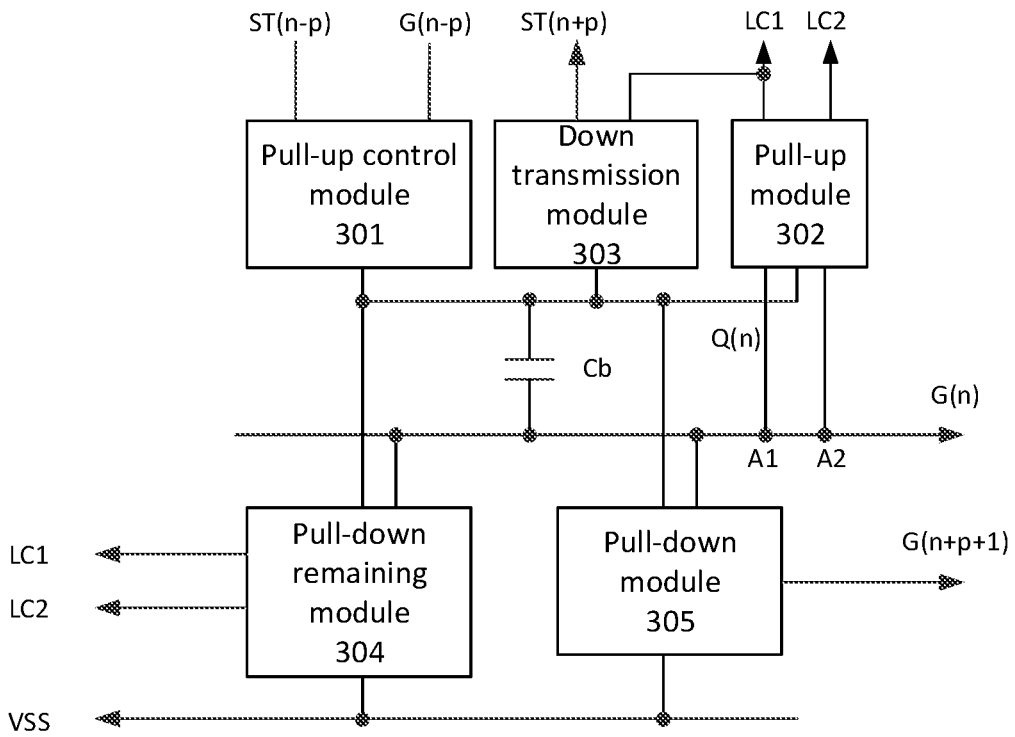
FIG. 3 is a structural schematic diagram illustrating a GOA circuit of the present application.

FIG. 3 is a structural schematic diagram illustrating a GOA circuit of the present application. As shown in FIG. 3, the embodiment of the present application provides a GOA circuit, which includes a plurality of stages of cascaded GOA units, wherein a n-th-stage GOA unit controls charging of a n-th-stage horizontal scan line. The n-th-stage GOA unit includes a pull-up control module 301, a pull-up module 302, a down transmission module 303, a pull-down remaining module 304, a pull-down module 305 and a bootstrap capacitor Cb.

The pull-up control module 301 is configured to receive a (n−p)-th-stage scan signal G(n−p) and pull down or pull up potential of a first node Q(n) under the control of a (n−p)-th-stage stage transmission signal ST(n−p), wherein n and p are natural numbers and n>p.

The pull-up module 302 is electrically connected to the first node Q(n) and receives a first oscillating signal LC1 and a second oscillating signal LC2, and is configured to output a n-th-stage scan signal G(n) via a first port A1 based on the first oscillating signal LC1 and output the n-th-stage scan signal G(n) via a second port A2 based on the second oscillating signal LC2, wherein the first oscillating signal LC1 and the second oscillating signal LC2 are inverses of each other.

The down transmission module 303 is electrically connected to the first node Q(n) and receives the first oscillating signal LC1, and is configured to output a (n+p)-th-stage stage transmission signal ST(n+p).

The pull-down remaining module 304 is electrically connected to the first node Q(n) and receives a first voltage level signal VSS, the first oscillating signal LC1, the second oscillating signal LC2 and the n-th-stage scan signal G(n), and is configured to keep the first node Q(n) at low potential.

The pull-down module 305 is electrically connected to the first node Q(n) and receives the first voltage level signal VSS and a (n+p+1)-th-stage scan signal G(n+p+1), and is configured to pull down the potential of the first node Q(n) and pull down the potential of the n-th-stage scan signal G(n).

The bootstrap capacitor Cb is electrically connected to the first node Q(n) and receives the n-th-stage scan signal G(n).

Figure 4:
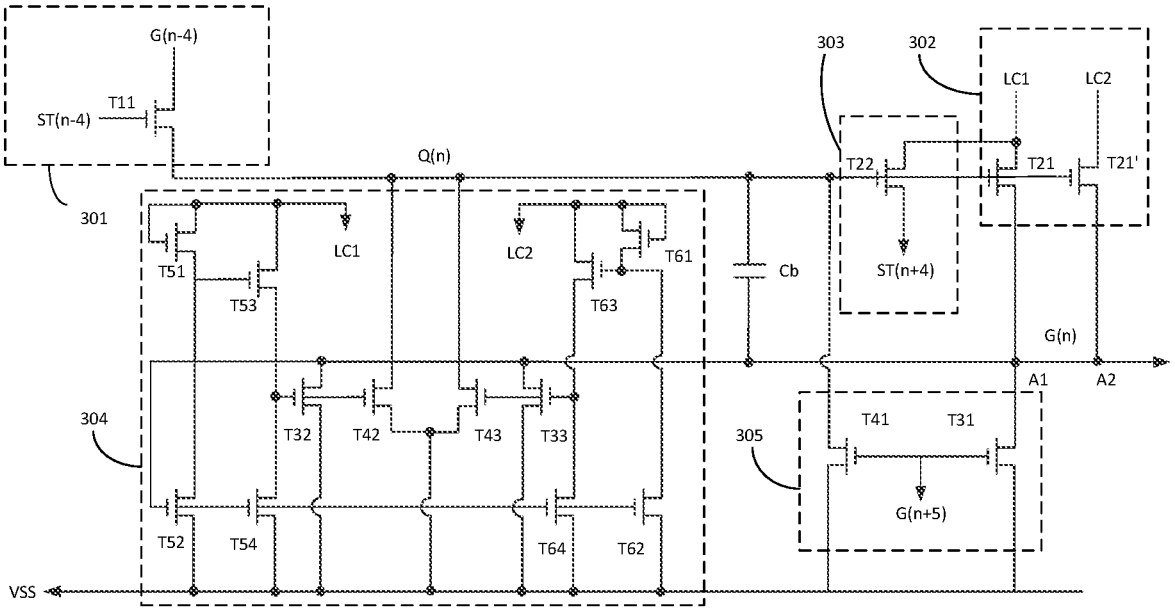
FIG. 4 is a circuit diagram of an embodiment of a GOA circuit of the present application.

Exemplarily, FIG. 4 is a circuit diagram of an embodiment of a GOA circuit of the present application. As shown in FIG. 4, the n-th-stage GOA unit of the GOA circuit includes a pull-up control module 301, a pull-up module 302, a down transmission module 303, a pull-down remaining module 304, a pull-down module 305 and a bootstrap capacitor Cb. In the present embodiment, the value of p is 4. It should be noted that the value of p in the present embodiment is just an example, and it should not be construed as a limit to the present application.

The pull-up control module 301 includes a control transistor T11, a gate of which receives the (n−4)-th-stage stage transmission signal ST(n−4), a first electrode of which is configured to receive the (n−4)-th-stage scan signal G(n−4), and a second electrode of which is electrically connected to the first node Q(n). Specifically, the control transistor T11 adopts a N-type thin-film transistor. The drain of the N-type thin-film transistor serves as the first electrode and the source of the N-type thin-film transistor serves as the second electrode.

The pull-up module 302 includes a first pull-up transistor T21, a gate of which is electrically connected to the first node Q(n), a first electrode of which is configured to receive the first oscillating signal LC1, and a second electrode of which is electrically connected to the first port A1 and is configured to output the n-th-stage scan signal G(n); and a second pull-up transistor T21', a gate of which is electrically connected to the first node Q(n), a first electrode of which is configured to receive the second oscillating signal LC2, and a second electrode of which is electrically connected to the second port A2 and is configured to output the n-th-stage scan signal G(n). Specifically, both of the first pull-down transistor T21 and the second pull-down transistor T21' adopt N-type thin-film transistors, the drains of which serve as the first electrodes and the sources of which serve as the second electrodes. The first oscillating signal LC1 and the second oscillating signal LC2 are low-frequency alternating signals and have high and low signals with potential opposite to each other. For example, the first oscillating signal LC1 and the second oscillating signal LC2 are square waves.

Figure 1:
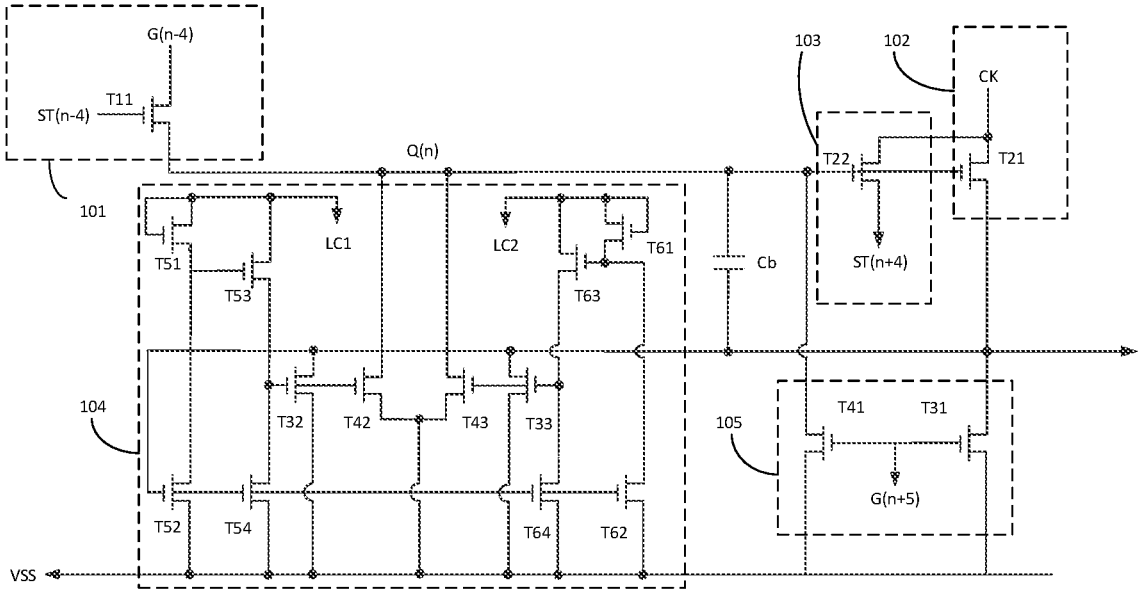
FIG. 1 is a circuit diagram illustrating a GOA circuit in existing skills.
Figure 2:
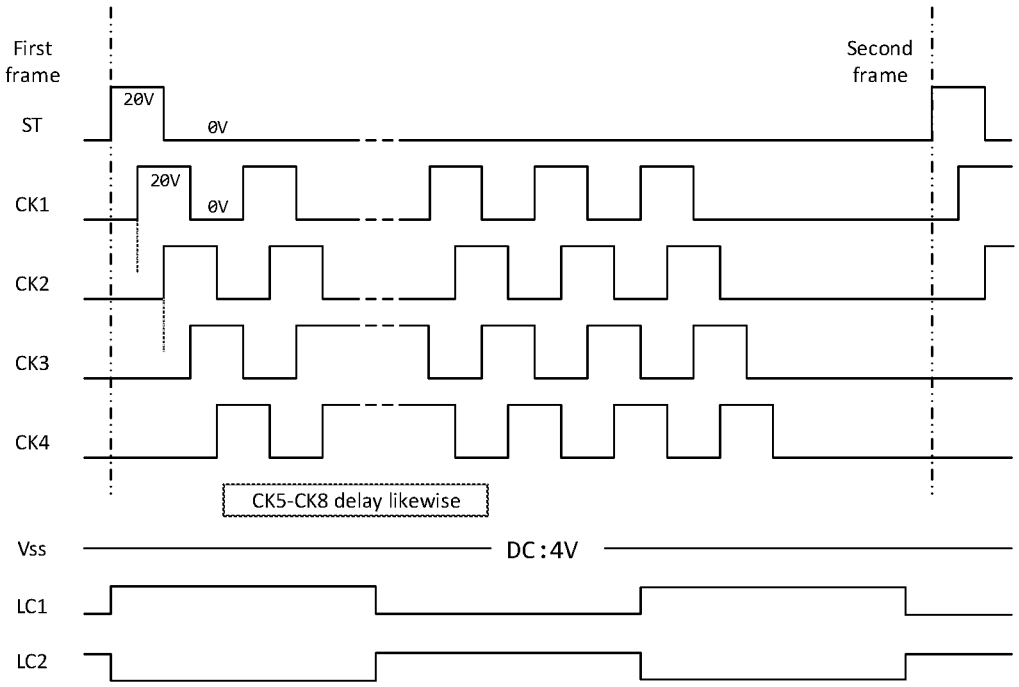
FIG. 2 is a diagram illustrating a drive timing of the GOA circuit shown in FIG. 1.

The timing of the first oscillating signal LC1 and the second oscillating signal LC2 can be referred to FIG. 2. As shown in FIG. 2, the first oscillating signal LC1 and the second oscillating signal L2 are square waves and are inverses of each other. The period of the square waves is 2.5 s. In one period, each of the high voltage level and the low voltage level occupies 100 frames.

There are two output ports in each GOA circuit unit for binding driving signals to the oscillating signals. Under the driving of the first oscillating signal LC1 and the second oscillating signal LC2, the first port A1 and the second port A2 can output alternatively. For example, whenever the first oscillating signal LC1 received by the first pull-up transistor T21 is at low voltage level, the second oscillating signal LC2 received by the second pull-up transistor T21' is at high voltage level. It can output the scan signal G(n) normally.

The down transmission module 303 includes a down transmission transistor, a gate of which is electrically connected to the first node Q(n), a first electrode of which is configured to receive the first oscillating signal LC1, and a second electrode of which is configured to output the (n+p)-th-stage stage transmission signal ST(n+p). Specifically, the down transmission transistor T21 adopts a N-type thin-film transistor, the drain of which serves as the first electrode and the source of which serves as the second electrode.

The pull-down remaining module is electrically connected to the first node Q(n) and receives a first voltage level signal VSS, the first oscillating signal LC1, the second oscillating signal LC2 and the n-th-stage scan signal G(n), and is configured to keep the first node Q(n) at low potential. The timing of LC1 and LC2 can be referred to FIG. 2. The pull-down remaining module 304 includes a first remaining unit and a second remaining unit. The first remaining unit and the second remaining unit are of a same structure and are disposed symmetrically.

In a further embodiment, the first remaining unit includes a first transistor T32, a second transistor T42, a third transistor T51, a fourth transistor T52, a fifth transistor T53 and a sixth transistor T54. Specifically, the aforesaid transistors adopt N-type thin-film transistors, the drain of which serves as the first electrode and the source of which serves as the second electrode. The gate of the first transistor T32 is electrically connected to the gate of the second transistor T42. The drain of the first transistor T31 is configured to receive the n-th-stage scan signal G(n) and the source of the first transistor T31 is configured to receive the first voltage level signal VSS. The drain of the second transistor T42 is electrically connected to the first node Q(n) and the source of the second transistor T42 is configured to receive the first voltage level signal VSS. The gate and drain of the third transistor T51 are configured to receive the first oscillating signal LC1 and the source of the third transistor T51 is electrically connected to the source of the fourth transistor T52. The gate of the fourth transistor T52 is configured to receive the n-th-stage scan signal G(n) and the source of the fourth transistor T52 is configured to receive the first voltage level signal VSS. The gate of the fifth transistor T53 is electrically connected to the source of the third transistor T51, the drain of the fifth transistor T53 is configured to receive the first oscillating signal LC1 and the source of the fifth transistor T53 is electrically connected to the gate of the first transistor T32. The gate of the sixth transistor T54 is configured to receive the n-th-stage scan signal G(n), the drain of the sixth transistor T54 is electrically connected to the gate of the first transistor T32 and the source of the sixth transistor T54 is configured to receive the first voltage level signal VSS.

The second remaining unit includes a seventh transistor T33, an eighth transistor T43, a ninth transistor T61, a tenth transistor T62, an eleventh transistor T63 and a twelfth transistor T64. Specifically, the aforesaid transistors adopt N-type thin-film transistors, the drain of which serves as the first electrode and the source in of which serves as the second electrode. The gate of the seventh transistor T33 is electrically connected to the gate of the eighth transistor T43. The drain of the seventh transistor T33 is configured to receive the n-th-stage scan signal G(n) and the source of the seventh transistor T33 is configured to receive the first voltage level signal VSS. The drain of the eighth transistor T43 is electrically connected to the first node Q(n) and the source of the eighth transistor T43 is configured to receive the first voltage level signal VSS. The gate and drain of the ninth transistor T61 are configured to receive the second oscillating signal LC2 and the source of the ninth transistor T61 is electrically connected to the drain of the tenth transistor T62. The gate of the tenth transistor T62 is configured to receive the n-th-stage scan signal G(n) and the source of the tenth transistor T62 is configured to receive the first voltage level signal VSS. The gate of the eleventh transistor T63 is electrically connected to the source of the ninth transistor T61, the drain of the eleventh transistor T63 is configured to receive the first oscillating signal LC2 and the source of the eleventh transistor T63 is electrically connected to the gate of the seventh transistor T33. The gate of the transistor T64 is configured to receive the n-th-stage scan signal G(n), the drain of the twelfth transistor T64 is electrically connected to the gate of the seventh transistor T33 and the source of the twelfth transistor T64 is configured to receive the first voltage level signal VSS.

The pull-down module 305 includes a first pull-down transistor T31, a gate of which is configured to receive the (n+5)-th-stage scan signal G(n+5), a first electrode of which is configured to pull down the potential of the n-th-stage scan signal G(n), and a second electrode of which is configured to receive the first voltage level signal VSS; and a second pull-down transistor T41, a gate of which is configured to receive the (n+5)-th-stage scan signal G(n+5), a first electrode of which is configured to pull down the potential of the first node Q(n), and a second electrode of which is configured to receive the first voltage level signal VSS. Specifically, both of the first pull-down transistor T31 and the second pull-down transistor T41 adopt N-type thin-film transistors, the drains of which serve as the first electrodes and the sources of which serve as the second electrodes.

Figure 5:
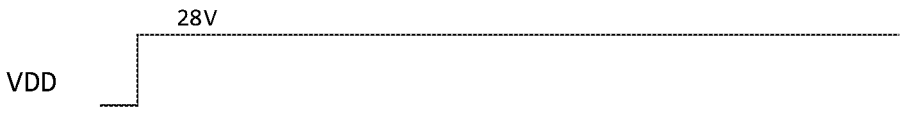
FIG. 5 is a diagram illustrating a drive timing in comparison to the GOA circuit shown in FIG. 4.

FIG. 5 is a diagram illustrating a drive timing in comparison to the GOA circuit shown in FIG. 4. As a comparison as shown in FIG. 5, a direct-current signal VDD is used to replace the existing clock signal CK without adding the second pull-up transistor T21', where the clock signal CK serves as an access signal of the pull-up module 302 and the down transmission module 303. Since the direct-current signal VDD is used for the pull-up transistor T21 of the pull-up module 302, the pull-up transistor T21 can be turned on along with the first node Q(n). This saves the rising time and falling time in existing skill using the clock signal CK and yields a better output of the scan signal. Meanwhile, since the first pull-down transistor T31 of the pull-down module is used to pull down the voltages, the size of the pull-up transistor T21 can be reduced. Also, the first pull-down transistor T31 does not directly bear the load on a clock signal line. The load on the clock signal line decreases, electric current becomes small and the frequency turns from 60 hz/120 hz as usual into a direct current such that the power consumption is greatly reduced and it alleviates heating problems. However, since the pull-up transistor T21 accesses the direct-current signal VDD for a long time, the threshold value of the transistor has a serious shift. This resulting in worse reliability and lifespan of the circuit.

In the present application, the GOA circuit uses the pull-down module to pull down voltages. The size of the pull-up transistor T21 can be reduced. The pull-down module does not directly bear the load on the clock signal line. The load on the clock signal line decreases, electric current becomes small and heating problem can be alleviated. Meanwhile, the second pull-up transistor T21' is added. The direct-current driving signal VDD binds to the oscillating signals LC. Also, each GOA circuit unit has two output ports. In such a way, whenever one pull-up transistor operates, the other pull-up transistor can rest. That is, the first pull-up transistor and the second pull-up transistor operate alternatively. This ensures that the stress suffered by the pull-up transistor decreases, reduces the pressure time and lower the shift of the threshold voltage of the transistor, thereby improving the reliability and lifespan of the circuit. Moreover, the oscillating signals LC directly uses the oscillating signals LC1 and LC2 in current circuit without having to occupy additional layout space, thereby reducing the room of bezel and cost in a further step.

Based on the same inventive concept, the present application further provides a display panel.

Figure 6:
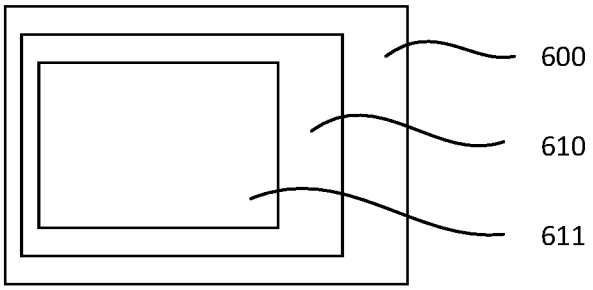
FIG. 6 is a structural schematic diagram illustrating a display panel of the present application.

FIG. 6 is a structural schematic diagram illustrating a display panel of the present application. As shown in FIG. 6, the display panel 600 includes an array substrate 610, which includes the afore-described GOA circuit 611.

The display panel 600 can be a liquid crystal display panel or an organic light emitting diode (OLED) display panel.

Above all, adopting the display panel having the GOA circuit according to the present application can alleviate heating problem. Meanwhile, the rising time and the falling time of the clock signal used in existing skills are saved and the output of the scan signal will become better. The two output ports function alternatively. Whenever one operates, the other one goes with stress recovery. This reduces the shift of threshold value of the transistor caused by high-voltage-level stress during image display, thereby improving the reliability and lifespan of the circuit. Moreover, the low-frequency alternating signal directly uses the LC signal in current circuit without having to occupy additional layout space, thereby reducing the room of bezel and cost in a further step.

It should be understood that those of ordinary skill in the art may make equivalent modifications or variations according to the technical schemes and invention concepts of the present application, but all such modifications and variations should be within the appended claims of the present application.

The invention claimed is:

1. A gate-on-array (GOA) circuit, comprising a plurality of stages of cascaded GOA units, wherein a n-th-stage GOA unit controls charging of a n-th-stage horizontal scan line, and wherein the n-th-stage GOA unit comprises:

a pull-up control module, electrically connected to a first node (Q(n)) and receiving a (n−p)-th-stage scan signal (G(n−p)) and a (n−p)-th-stage stage transmission signal (ST(n−p)), configured to pull down or pull up potential of the first node (Q(n)), wherein n and p are natural numbers and n>p;

a pull-up module, comprising a first pull-up transistor, a gate of which is electrically connected to the first node (Q(n)), a first electrode of which is configured to receive a first oscillating signal (LC1), and a second electrode of which is electrically connected to a first port (A1) and is configured to output the n-th-stage scan signal (G(n)); and a second pull-up transistor, a gate of which is electrically connected to the first node (Q(n)), a first electrode of which is configured to receive a second oscillating signal (LC2), and a second electrode of which is electrically connected to a second port (A2) and is configured to output the n-th-stage scan signal (G(n)), wherein the first oscillating signal (LC1) and the second oscillating signal (LC2) are inverses of each other, and the first pull-up transistor and the second pull-up transistor operate alternatively, and the first oscillating signal (LC1) and the second oscillating signal (LC2) are square waves, and a direct-current driving signal (VDD) binds to the first oscillating signal (LC1) and the second oscillating signal (LC2);

a down transmission module, electrically connected to the first node (Q(n)) and receiving the first oscillating signal (LC1), configured to output a (n+p)-th-stage stage transmission signal (ST(n+p));

a pull-down remaining module, electrically connected to the first node (Q(n)) and receiving a first voltage level signal (VSS), the first oscillating signal (LC1), the second oscillating signal (LC2) and the n-th-stage scan signal (G(n)), configured to keep the first node (Q(n)) at low potential;

a pull-down module, electrically connected to the first node (Q(n)) and receiving the first voltage level signal (VSS) and a (n+p+1)-th-stage scan signal (G(n+p+1)), configured to pull down the potential of the first node (Q(n)) and pull down the potential of the n-th-stage scan signal (G(n)); and a bootstrap capacitor, electrically connected to the first node (Q(n)) and receiving the n-th-stage scan signal (G(n)).

2. The GOA circuit according to claim 1, wherein the first port (A1) and the second port (A2) output alternatively.

3. The GOA circuit according to claim 1, wherein the pull-up control module comprises a control transistor, a gate of which is configured to receive the (n−p)-th-stage stage transmission signal (ST(n−p)), a first electrode of which is configured to receive the (n−p)-th-stage scan signal (G(n−p)), and a second electrode of which is electrically connected to the first node (Q(n)).

4. The GOA circuit according to claim 1, wherein the down transmission module comprises a down transmission transistor, a gate of which is electrically connected to the first node (Q(n)), a first electrode of which is configured to receive the first oscillating signal (LC1), and a second electrode of which is configured to output the (n+p)-th-stage stage transmission signal (ST(n+p)).

5. The GOA circuit according to claim 1, wherein the pull-down remaining module comprises:

a first remaining unit, electrically connected to the first node (Q(n)) and receiving the first oscillating signal (LC1), the first voltage level signal (VSS) and the n-th-stage scan signal (G(n)); and a second remaining unit, electrically connected to the first node (Q(n)) and receiving the second oscillating signal (LC2), the first voltage level signal (VSS) and the n-th-stage scan signal (G(n)).

6. The GOA circuit according to claim 1, wherein the pull-down module comprises:

a first pull-down transistor, a gate of which is configured to receive the (n+p+1)-th-stage scan signal (G(n+p+1)), a first electrode of which is configured to pull down the potential of the n-th-stage scan signal (G(n)), and a second electrode of which is configured to receive the first voltage level signal (VSS); and a second pull-down transistor, a gate of which is configured to receive the (n+p+1)-th-stage scan signal (G(n+p+1)), a first electrode of which is configured to pull down the potential of the first node (Q(n)), and a second electrode of which is configured to receive the first voltage level signal (VSS).

7. A display panel, comprising an array substrate, which comprises a gate-on-array (GOA) circuit comprising a plurality of stages of cascaded GOA units, wherein a n-th-stage GOA unit controls charging of a n-th-stage horizontal scan line, and wherein the n-th-stage GOA unit comprises:

a pull-up control module, electrically connected to a first node (Q(n)) and receiving a (n−p)-th-stage scan signal (G(n−p)) and a (n−p)-th-stage stage transmission signal (ST(n−p)), configured to pull down or pull up potential of the first node (Q(n)), wherein n and p are natural numbers and n>p;

a pull-up module, comprising a first pull-up transistor, a gate of which is electrically connected to the first node (Q(n)), a first electrode of which is configured to receive a first oscillating signal (LC1), and a second electrode of which is electrically connected to a first port (A1) and is configured to output the n-th-stage scan signal (G(n)); and a second pull-up transistor, a gate of which is electrically connected to the first node (Q(n)), a first electrode of which is configured to receive a second oscillating signal (LC2), and a second electrode of which is electrically connected to a second port (A2) and is configured to output the n-th-stage scan signal (G(n)), wherein the first oscillating signal (LC1) and the second oscillating signal (LC2) are inverses of each other, and the first pull-up transistor and the second pull-up transistor operate alternatively, and the first oscillating signal (LC1) and the second oscillating signal (LC2) are square waves, and a direct-current driving signal (VDD) binds to the first oscillating signal (LC1) and the second oscillating signal (LC2);

a down transmission module, electrically connected to the first node (Q(n)) and receiving the first oscillating signal (LC1), configured to output a (n+p)-th-stage stage transmission signal (ST(n+p));

a pull-down remaining module, electrically connected to the first node (Q(n)) and receiving a first voltage level signal (VSS), the first oscillating signal (LC1), the second oscillating signal (LC2) and the n-th-stage scan signal (G(n)), configured to keep the first node (Q(n)) at low potential;

a pull-down module, electrically connected to the first node (Q(n)) and receiving the first voltage level signal (VSS) and a (n+p+1)-th-stage scan signal (G(n+p+1)), configured to pull down the potential of the first node (Q(n)) and pull down the potential of the n-th-stage scan signal (G(n)); and a bootstrap capacitor, electrically connected to the first node (Q(n)) and receiving the n-th-stage scan signal (G(n)).

8. The display panel according to claim 7, wherein the first port (A1) and the second port (A2) output alternatively.

9. The display panel according to claim 7, wherein the pull-up control module of the n-th-stage GOA unit comprises a control transistor, a gate of which is configured to receive the (n−p)-th-stage stage transmission signal (ST(n−p)), a first electrode of which is configured to receive the (n−p)-th-stage scan signal (G(n−p)), and a second electrode of which is electrically connected to the first node (Q(n)).

10. The display panel according to claim 7, wherein the down transmission module of the n-th-stage GOA unit comprises a down transmission transistor, a gate of which is electrically connected to the first node (Q(n)), a first electrode of which is configured to receive the first oscillating signal (LC1), and a second electrode of which is configured to output the (n+p)-th-stage stage transmission signal (ST(n+p)).

11. The display panel according to claim 7, wherein the pull-down remaining module of the n-th-stage GOA unit comprises:

a first remaining unit, electrically connected to the first node (Q(n)) and receiving the first oscillating signal (LC1), the first voltage level signal (VSS) and the n-th-stage scan signal (G(n)); and a second remaining unit, electrically connected to the first node (Q(n)) and receiving the second oscillating signal (LC2), the first voltage level signal (VSS) and the n-th-stage scan signal (G(n)).

12. The display panel according to claim 7, wherein the pull-down module of the n-th-stage GOA unit comprises:

a first pull-down transistor, a gate of which is configured to receive the (n+p+1)-th-stage scan signal (G(n+p+1)), a first electrode of which is configured to pull down the potential of the n-th-stage scan signal (G(n)), and a second electrode of which is configured to receive the first voltage level signal (VSS); and a second pull-down transistor, a gate of which is configured to receive the (n+p+1)-th-stage scan signal (G(n+p+1)), a first electrode of which is configured to pull down the potential of the first node (Q(n)), and a second electrode of which is configured to receive the first voltage level signal (VSS).

13. The display panel according to claim 7, wherein the display panel is a liquid crystal display panel or an organic light emitting diode (OLED) display panel.

* * * * *